United States Patent [19]

Chuang et al.

[11] Patent Number: 4,762,153

[45] Date of Patent: Aug. 9, 1988

[54] WEAVING LOOM WITH MAGNETIC SHUTTLE

[76] Inventors: Wu-Chen Chuang, No. 6, Lane 70, Ting-Mei I St.; Chi-Shuang Huang, No. 23, Lane 235, Kai-San Rd., both of Tainan; Vincent Chuang, No. 30, Lane 100, Kuang-Hua I Rd., Kaohsiung, all of Taiwan

[21] Appl. No.: 3,557

[22] Filed: Jan. 15, 1987

[51] Int. Cl.[4] ..... D03D 49/26

[52] U.S. Cl. ..... 139/134; 139/439; 139/196.2

[58] Field of Search ..... 139/143, 436, 438, 439, 139/196.2

[56] References Cited

U.S. PATENT DOCUMENTS

| | | | |
|---|---|---|---|
| 2,630,839 | 3/1953 | Birtwell | 139/439 |
| 2,799,295 | 7/1957 | Juillard et al. | 139/134 |
| 3,543,807 | 12/1970 | Moessinger | 139/439 |
| 3,902,535 | 9/1975 | Jusko et al. | 139/439 |
| 4,529,016 | 7/1985 | Schlecht et al. | 139/438 |

*Primary Examiner*—Henry S. Jaudon

*Attorney, Agent, or Firm*—Lackenbach Siegel Marzullo & Aronson

[57] ABSTRACT

A weaving loom with a magnetic shuttle comprised of an endless loop for guiding the shuttle to circulate and fly through the shed of warp and a magnetic means constructed as a structure which generates a magnetic force circulating along the endless loop for attracting and driving the shuttle.

4 Claims, 3 Drawing Sheets

WEAVING LOOM WITH MAGNETIC SHUTTLE

BACKGROUND OF THE INVENTION

The present invention relates to a weaving loom with a magnetic shuttle, and more particularly to a type of weaving loom in which the shuttle is driven by magnetic means and circulates along an endless race loop, by which the high flying speed of shuttle can be kept constant and the operational efficiency of the weaving loom may be improved.

As is well known, the type of weaving loom with a magnetic shuttle has gained momentum in today's textile manufacturing field. The conventional type of weaving loom with a magnetic shuttle comprises a shuttle which reciprocates along a race plate passing through the shed of warp, and the race plate is generally annexed to the reed assembly of the weaving loom so that it can move with the reed assembly in a beating motion. U.S. Pat. No. 3,863,682 shows an electrically operated race for producing a travelling field. Japanese Unexamined Patent Publication No. 59-71461 shows a weaving loom in which the shuttle is driven by the repulsive force generated by a linear motor. Japanese Unexamined Patent Publication No. 54-23773 shows a shuttle driven by the attrative force of a magnetic means which is annexed to a reciprocating belt. Japanese Unexamined Utility Model Publication No. 58-83483 shows a shuttle which is driven with the mode provided by the above-mentioned 54-23733, but the construction of which comprises a series of permanent magnets aligned in unlike pole orientation next to each other, and the magnetic means for driving the shuttle also comprises a series of permanent magnets which are aligned in unlike pole orientation next to each other, any one of which faces one permanent magnet of the shuttle with unlike pole relation.

However, the shuttles of the above-mentioned types all reprocate in a manner such as the mode shown in FIG. 1 of the above-mentioned No. 58-83483, or as shown in FIG. 3 in which the flying speed of the shuttle in a picking motion is accelerated from 0 to a high constant speed and then braked and decelerated to 0, followed by a beating motion being finished, then the same action repeated towards the opposite direction, and again, and again. That is to say, the flying speed of the shuttle is not kept constant, especially at the top end.

Further, the shuttles of the conventional types are all guided by a race plate passing through the shed of warp, such as shown in FIG. 3 of the above-mentioned No. 59-71461, which is annexed to the reed assembly of the weaving loom so that the race plate can reciprocate with the reed assembly and ensure the beating motion may not be obstructed. Therefore, the reed assembly must be heavy and the speed of the beating motion slow. In addition, the stroke of the beating motion drags reluctantly when taking off the weft, which is drawn tranvsersely into the shed of warp by the shuttle flying through the same in a picking motion, from the race plate.

SUMMARY OF THE INVENTION

Therefore, an object of the present invention is to provide a weaving loom with a magnetic shuttle which an keep the speed of the flying shuttle high and constant so that the period of the picking motion may be reduced.

Another object of the present invention is to provide a weaving loom with a magnetic shuttle of a construction without any race plate passing through the shed of warp so that the weight of the reed assembly and the stroke of the beating motion may be reduced.

That is, the final object of the present invention is to provide a weaving loom with a magnetic shuttle by which the periods of picking motion and beating motion may be reduced and the operational efficiency may be improved.

Accordingly, the present invention provides a weaving loom with a magnetic shuttle comprising a means for supplying the warp in let-off motion, a means for shedding the warp in shedding motion, a shuttle for guiding the weft into the shed of the warp in picking motion, a race rail for guiding the shuttle into the shed of the warp, a magnet means for attracting and driving the shuttle, a reed assembly for beating the weft, which is picked in the shed of the warp, into the fell in the front line of the same in beating motion and a means for reciprocating the reed assembly in beating motion, characterized in that the race rail is constructed as an endless loop and the magnet means is constructed as a structure which generates a magnetic force circulating along said endless loop so that the shuttle may be guided by the race rail loop and driven by the magnetic force, and circulate along the race rail loop endlessly.

Specifically, the magnetic means comprises an endless circulating belt parallel to the race rail loop and a series of magnets annexed to the belt, so that the series of magnets may circulate and drive the shuttle moving along the race rail loop.

More specifically, the portion of the race rail loop passing through the shed of warp has an elongated opening, and the reed assembly comprises a series of reed dents having a horizontal portion by which a horizontal surface is formed and adapted to be disposed in the above-mentioned opening and aligned with the surface of the race rail loop, so that the shuttle can fly along the surface and pass through the shed of warp.

BRIEF DESCRIPTION OF THE DRAWINGS

The present invention is illustrated by way of example in the accompanying drawings, in which.

DETAILED DESCRIPTION OF THE INVENTION

Figure 1:
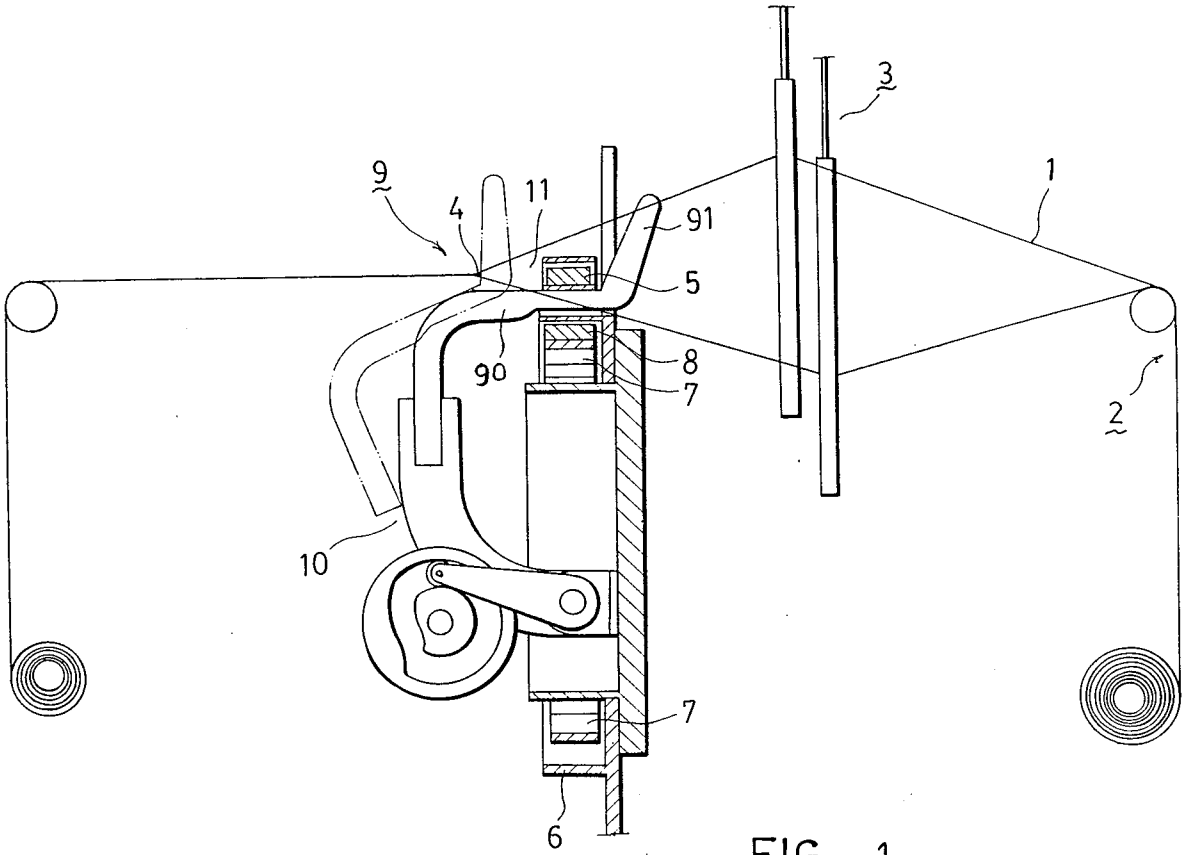
FIG. 1 is a schematic representation of an embodiment according to the present invention.
Figure 2:
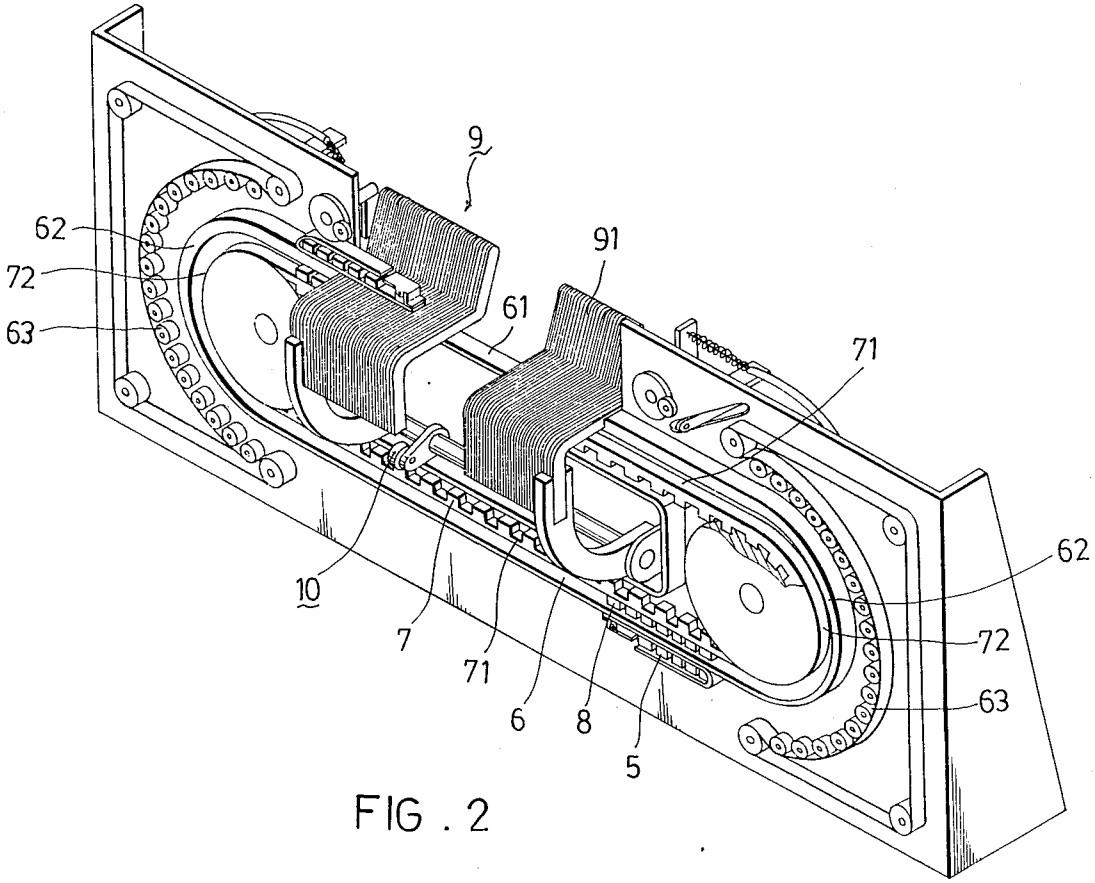
FIG. 2 is a perspective view of the central portion of FIG. 1.

Referring to FIG. 1 and FIG. 2, the weaving loom according to the present invention comprises a means 2 for supplying the warp 1 in let-off motion, a means 3 for shedding the supplied warp 1 in shedding motion, a shuttle 5 for picking the weft 4 into the shed 11 of warp 1 transversely in a picking motion, a race rail 6 for guiding the shuttle 5 into the shed 11 of warp 1 transversely in a picking motion, a magnetic means 7, 8 for attracting and driving the shuttle 5 to fly along the race rail 6, a reed assembly 9 for beating the picked weft 4 into the fell in front line of the shed 11 in a beating motion and a means 10 for reciprocating the reed assembly 9. As shown in FIG. 2, the race rail 6 is formed as an endless loop, and the magnet means 7, 8 are constructed as a structure which generates a magnet force circulating along the endless loop. In detail, the magnet means 7, 8 comprises an endless belt 7 parallel to the race rail loop 6 and a series of magnets 8. That is to say, the series of magnets 8 can circulate along the race rail loop 6 by the working of endless belt 7. The endless belt 7 is constructed as a structure of chain transmission which comprises horizontal portions 71 and curved portions 72. The portion of the race rail loop 6 which passes the shed 11 transversely is formed as an elongated opening 61. The reed assembly 9 comprises a series of reed dents 91 having a horizontal portion which is aligned as a structure comprising a horizontal surface 90. This horizontal surface 90 is disposed in the above-mentioned elongated opening 61 and aligned with the surface of the race rail loop 6. That is to say, the shuttle 5 flies along the horizontal surface 90 and passes the shed 11 in a picking motion. There are two series of guiding rollers 63, 63 which are disposed along the curved portion 62, 62 in the ends of the race rail loop 6 respectively. The guiding rollers 63, 63 can guide the shuttle 5 safely to fly along the curved portions 62, 62 of the race rail loop 6 so that the shuttle 5 can not take off and deviate from the race rail loop because of the centrifugal force generated in the curved portions 62, 62.

Figure 3:
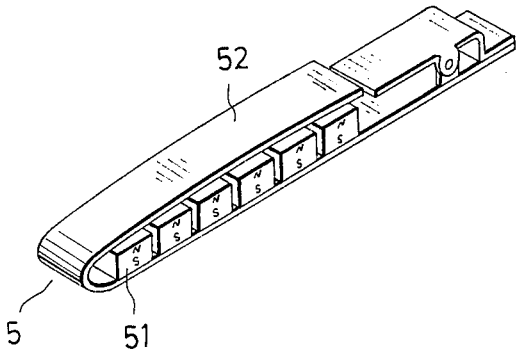
FIG. 3 is a perspective view of the shuttle of FIG. 1.

As shown in FIG. 3, the shuttle 5 comprises a series of magnets 51. The magnets 51 are aligned in unlike pole orientation next to each other and enveloped by a flexible material 52. The figure of the series of magnets 8 is omitted here, but the configuration is the same as the above-mentioned magnets 51 of the shuttle 5. Each magnet among magnets 8 is disposed to face one of the magnet among magnets 51 so the shuttle 5 can be attracted and driven strongly by the series of the magnets 8. And, due to the flexible construction of the shuttle 5 and the series of magnets 8, the shuttle 5 and the series of magnets 8 can fly smoothly along the curved portions 62, 72 respectively.

As in the above-mentioned embodiment, the weaving loom with a magnetic shuttle, according to the present invention, can reduce the periods of picking motion and beating motion, so that speed of the shuttle and the frequency of the picking, beating and shedding motion can be increased and the operational efficiency can be improved.

While the invention has been described in connection with what is presently considered to be the most practical and preferred embodiment, it is to be understood that the invention is not to be limited to the disclosed embodiment, but, on the contrary, is intended to cover various modifications and equilvalent arrangements included within the spirit and scope of the broadest interpretation so as to encompass all such modifications and equilvalent arrangements.

We claim:

1. A weaving loop comprising:

(a) means for supplying warps in a letoff motion;

(b) means for forming a shed between said warps;

(c) a race rail in the form on an endless loop with an elongated opening in the portion which transverses the shed; said endless loop of the race rail comprises parallel horizontal portions and two curved portions, each curved portion interconnecting adjacent ends of the horizontal portions, (d) a magnetic shuttle movable along said race rail for guiding wefts into the shed;

(e) magnetic drive means comprising a belt extending along the race rail and electrically operated to circulate around the race rail, and a first series of magnets fixed on said belt for attracting and driving the magnetic shuttle to fly along the race rail;

(f) a reed assembly comprising a series of aligned reed dents, each reed dent having a horizontal portion so aligned to form a horizontal surface which takes the place of said rail race for guiding said shuttle in passing the shed; and (g) means connected to said reed assembly for reciprocating it; whereby said shuttle is moved at a constant speed in a smooth manner due to said endless race rail.

2. A weaving loom as in claim 1, wherein each curved portion of said race rail is fitted with a plurality of guiding rollers, whereby the magnetic shuttle passes the curved portion safely.

3. A weaving loom as in claim 1, wherein the magnetic shuttle comprises a second series of magnets, aligned with unlike pole orientation next to each other and enveloped in a flexible material.

4. A weaving loom comprising:

(a) means for supplying warps in a let-off motion;

(b) means for forming a shed between the warps in a shedding motion;

(c) a magnetic shuttle for picking the weft into the shed of the warp transversely in a picking motion;

(d) a race rail in the form of an endless loop with an elongated opening in the portion which traverses the shed in a picking motion, said loop comprising two parallel horizontal portions and two curved portions, each curved portion interconnecting adjacent ends of the horizontal portions, and each curved portion fitted with a plurality of guiding rollers, whereby the magnetic shuttle passes the curved portion safely;

(e) magnetic drive means comprising a belt extending along the race rail and electrically operated to circulate around the race rail, and a first series of magnets fixed on said belt for attracting and driving the magnetic shuttle to fly along the race rail;

(f) a reed assembly for beating the picked weft into the fell in the front line of the warp shed comprising a series of aligned reed dents, each reed dent having a horizontal portion so aligned to form a horizontal surface disposed in the elongated opening of the race rail; and (g) means connected to said reed assembly for reciprocating it.

* * * * *